United States Patent [19]

Dickson

[11] 4,136,623

[45] Jan. 30, 1979

[54] FURNITURE CONSTRUCTION

[76] Inventor: Billy R. Dickson, 3313 Marzelle, Houston, Tex. 77093

[21] Appl. No.: 847,028

[22] Filed: Oct. 31, 1977

[51] Int. Cl.[2] ..... A47B 3/00

[52] U.S. Cl. ..... 108/111; 108/92

[58] Field of Search ..... 108/59, 92, 101, 110, 108/111; 211/134, 189, 190

[56] References Cited

U.S. PATENT DOCUMENTS

| | | | |
|---|---|---|---|
| 269,625 | 12/1882 | Blake | 108/144 X |
| 1,518,148 | 12/1924 | Kamenstein | 108/92 X |
| 1,681,218 | 8/1928 | Carlson | 108/110 |
| 2,005,566 | 6/1935 | Schwabe | 108/111 |
| 3,021,961 | 2/1962 | Ruhnke | 211/190 |

*Primary Examiner*—James C. Mitchell

*Attorney, Agent, or Firm*—Clarence A. O'Brien; Harvey B. Jacobson

[57] ABSTRACT

A furniture construction having planar first and second frames attached to one another such that the planes of each of the frames is perpendicular to the plane of the other of the frames. Preferably, at least two second frames are provided in spaced relation for assuring rigidity and stability of the construction. A load supporting platform, such as a shelf, is retained on the article of furniture by use of a plurality of coplanar notches provided on at least one of the frames.

5 Claims, 4 Drawing Figures

FURNITURE CONSTRUCTION

BACKGROUND OF THE INVENTION

1. Field of the Invention

This invention relates generally to furniture construction, and particularly to a new concept in furniture construction which permits almost any type of interior furniture to be built in a simple, yet rugged and reliable, manner.

2. Description of the Prior Art

Contemporary living styles require furniture which is not only pleasing to the eye, but is easy to move, store, and erect and knockdown. Such furniture must be durable as well as stylish, and generally must present a rather clean look when placed in a room, and the like.

Various proposals have been made for providing knockdown furniture, an example of which can be found in U.S. Pat. No. 1,424,419, issued Aug. 1, 1922, to J. A. Malarkey. This prior patent discloses a knockdown folding table employing a main frame supported on suitable feet and having folding leaves which can be supported in a raised position by suitable frames which swing outwardly to a position perpendicular to the extent of the main frame. Further, U.S. Pat. No. 2,005,566, issued June 18, 1935, to E. J. Schwabe, discloses a folding caddy wagon which employs a swinging foot and trays for permitting stability of the wagon during use, but permitting folding of same into a single plane for storage.

U.S. Pat. No. Des. 209,839, issued Jan. 9, 1968, to T. W. Tisdall, et al., discloses a book-shelf unit in which uprights extend from a base member and are provided with notches for receiving shelves in variable spacing along the upward extent of the unit, while U.S. Pat. No. 2,984,362, issued May 16, 1961, to E. F. Hamilton, discloses a shelf construction which uses grooves in the shelves themselves to engage with upright members in such a manner as to laterally space the uprights from one another.

SUMMARY OF THE INVENTION

It is an object of the present invention to provide a furniture construction which is easily erected and knocked down, while simultaneously being very durable and stylish.

It is another object of the present invention to provide a furniture construction which can be used for various kinds of furniture, but which employs a relatively small number of parts to achieve a rigid, yet lightweight structure.

It is still another object of the present invention to provide a furniture construction which can be assembled entirely by screw fasteners, eliminating the need for glue, nails, and the like.

Yet another object of the present invention is to provide a furniture construction permitting great versatility and adapability within a basic concept and with a minimum number of structural elements to be assembled.

These and other objects are achieved according to the present invention by providing a furniture construction having: a planar first frame; and a planar second frame attached to the first frame and arranged with the plane of the first frame substantially perpendicular to the plane of the second frame. Preferably, there are two or more second frames spaced from one another and disposed in substantially parallel planes perpendicular to the plane of the first frame for assuring a sturdy and stable structure, and for facilitating attachment of shelves and other load carrying platforms to the structure.

The frames advantageously are formed by rectangular frameworks each comprising two pairs of substantially parallel, longitudinally extending elements. Each pair of the elements is disposed perpendicular to the cooperating pair of elements, and each of the elements are connected together at longitudinal ends thereof to form an integral unit. Screw fasteners are the preferred mode of connection of the elements. One of the pair of elements of each frame crosses the other frame at a right angle and in common planes such that each of the cooperating frames is coextensive with the other.

Load carrying members, such as shelves, are attachable to the frames in a simple manner by provision on the frames of a plurality of coplanar notches arranged for selectively receiving the load carrying members. By this arrangement, shelves, and the like, can be arranged on the resulting rigid and stable framework as desired for a particular user of the resulting article of furniture. Alternatively, a load carrying member can be simply disposed on top of the framework when such is used as a table, seating, and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DESCRIPTION OF THE PREFERRED EMBODIMENTS

Figure 1:
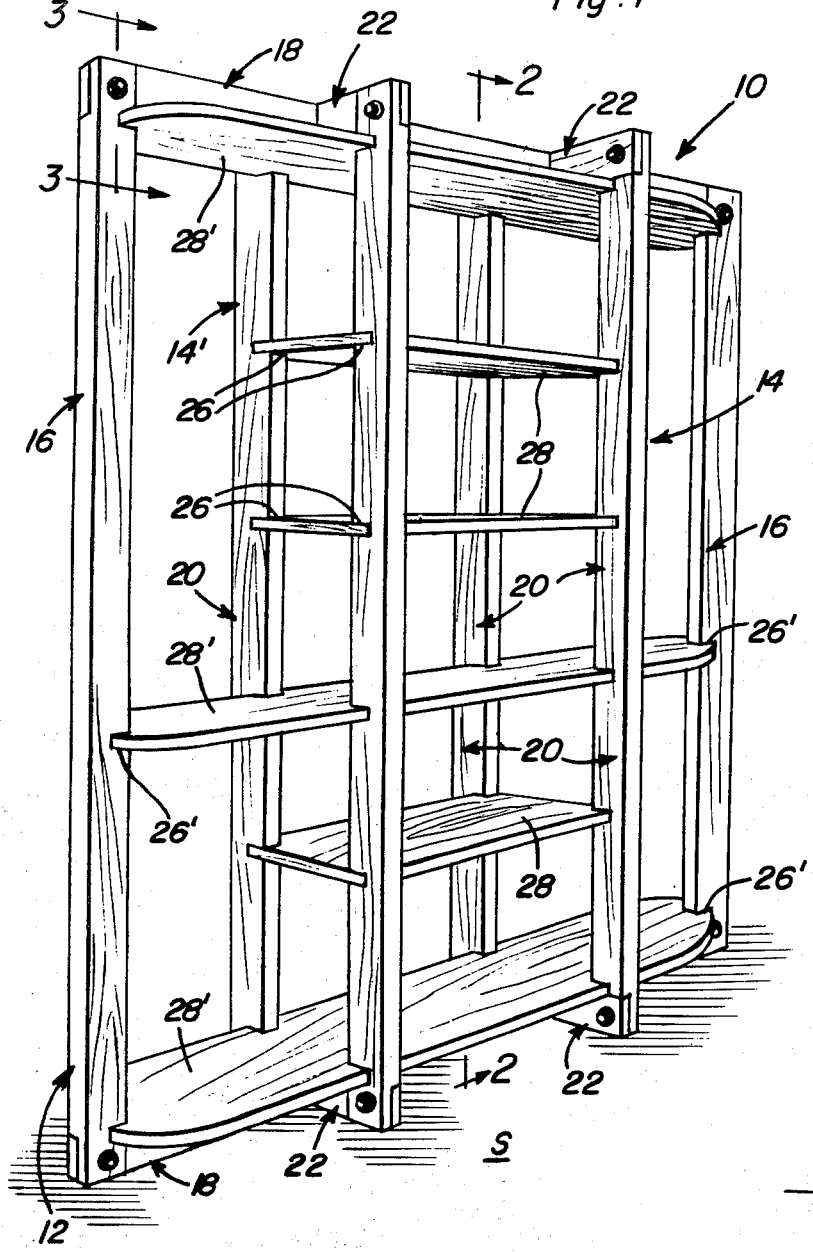
FIG. 1 is a schematic, perspective view showing shelving constructed in accordance with the present invention.
Figure 2:
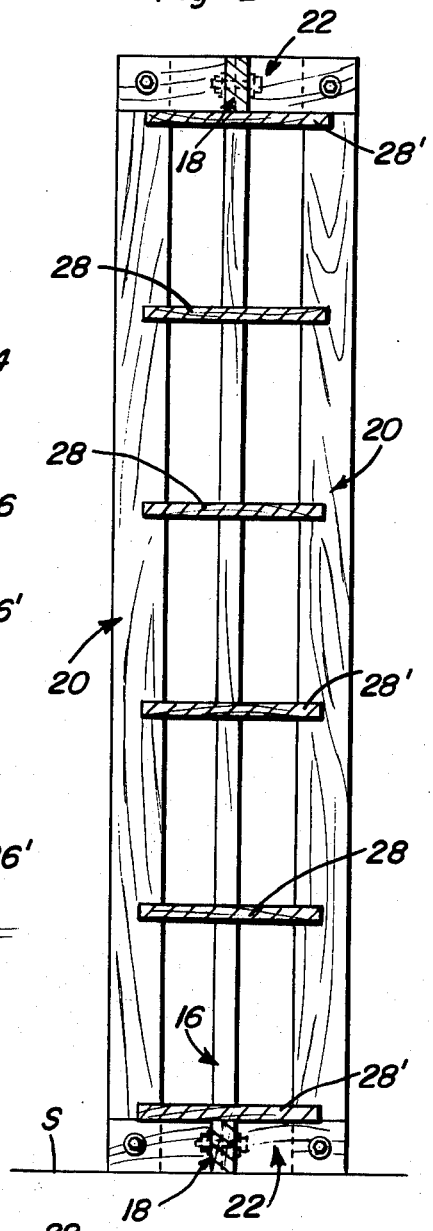
FIG. 2 is an enlarged, sectional view taken generally along the line 2—2 in FIG. 1.
Figure 3:
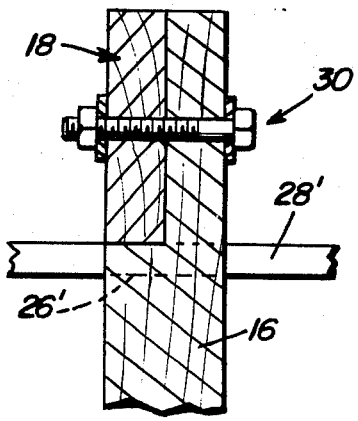
FIG. 3 is an enlarged, fragmentary, sectional view taken generally along the line 3—3 in FIG. 1.
Figure 4:
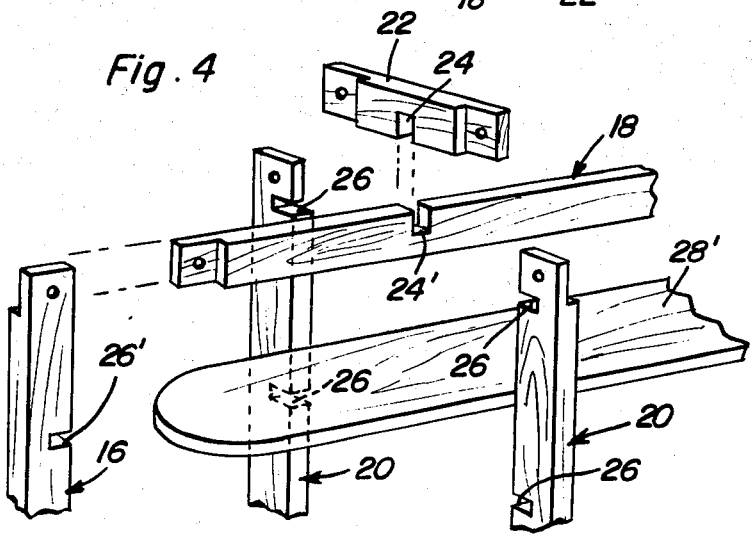
FIG. 4 is an enlarged, fragmentary, exploded, perspective view showing the upper left hand corner of the shelving seen in FIG. 1.

Referring now more particularly to the figures of the drawing, a furniture construction in the form of shelving 10 includes a planar first frame 12, which may be considered a main frame, and a pair of planar second frames 14 and 14' attached to frame 12 for rigidify and supporting frame 12 in a substantial vertical orientation on a supporting surface S. These frames 14, 14' each are arranged perpendicular to the plane of the main frame 12, and are disposed substantially parallel to, although spaced from, each other. The frames 12, 14, 14' are formed by rectangular frameworks, each of which frameworks comprises two pairs of substantially parallel, longitudinally extending elements 16, 18 and 20, 22, respectively. These elements are disposed perpendicular to one another, and are connected together to form an integral unit. One of the pairs of elements of each frame 12 and 14, 14' cross the other frame at substantially a right angle and lie in common planes. More specifically, notches or recesses 24, 24' are provided in elements 18, 22, respectively, substantially halfway through the thickness of the respective one of the elements for interengaging with one another in such a manner that the frames 12 and 14, 14' are substantially coextensive with one another. By this arrangement, substantially planar lower and upper surfaces are provided on the finished construction.

An attachment arrangement is associated with at least one of the frames 12, 14, 14' for mounting a load supporting member onto the structure. This attachment arrangement comprises opposed notches 26, 26' formed in the frames 12 and 14, 14', with a load supporting member 28, 28', such as shelving or other sheet material, being retainingly received in such notches 26, 26'. As can be appreciated, notches in addition to those illustrated in the drawing can be provided for further flexibility of shelving location. In particular, notches 26' can be provided coplanar with, for example, each set of the notches 26 so as to permit more flexible positioning of the members 28' on the shelving 10.

The elements 16, 18 and 20, 22 are advantageously connected together at end portions of the longitudinal extents thereof by lap joints secured as by the illustrated bolt assemblies 30. Not only does the use of bolt assemblies 30 enhance the durability and styling of the finished construction, but it eliminates the need for use of glue, nails, and the like, which render impractical the knocking-down and reerecting of furniture.

As can be readily understood from the above description and from the drawing, furniture construction in accordance with the present invention permits interlocking and self-supporting structures as appealing to the eye as they are practical. Although the description herein has been limited to shelving, it is to be understood that other articles of furniture, such as corner and end tables, dining and game tables, and the like, as well as sofas and chairs and other seating arrangements, are all within contemplation of the present invention. For example, the illustrated shelving can be modified by the addition of a third secondary frame, while only a single second frame can be employed in conjunction with a relatively narrow main or first frame in order to construct an end or corner table, not shown. Other tables and seating can be constructed by arranging a load-supporting member on top of the first and second frames. In addition, a desk, and the like, can be constructed by fastening frames of suitable height to the secondary frames of a construction as shown in the drawings so as to permit attachment of a desk surface between the second frames in a manner also not shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A furniture construction, comprising, in combination:

(a) a planar first frame; and (b) a planar second frame attached to the first frame, and arranged with the plane of the first frame substantially perpendicular to the plane of the second frame, each of the first frame and second frame being a rectangular framework comprising two pairs of substantially parallel, longitudinally extending elements disposed perpendicular to one another and connected together at longitudinally spaced ends thereof to form an integral unit, one of the pairs of elements of each frame crossing the other frame at substantially a right angle and in common planes, there being a pair of second frames, each of the second frames being arranged substantially perpendicular to the first frame and substantially parallel to and spaced from the other of the second frames, the latter having extents transverse of the first frame substantially equal and less than half the extent of the first frame perpendicular to the extent of the second frames, the second frames being spaced symmetrically along the extent of the first frame.

2. A structure as defined in claim 1, further including attachment means associated with at least one of the first frame and the second frames for mounting a load supporting member on the structure.

3. A structure as defined in claim 2, wherein the attachment means comprises opposed, coplanar notches formed in at least one of the first frame and the second frames, the load supporting member being a sheet retainingly received in the notches.

4. A structure as defined in claim 3, wherein the notches are provided perpendicular to the longitudinal extent of an associated one of the elements.

5. A structure as defined in claim 4, wherein there are a plurality of sets of coplanar notches and a plurality of load supporting members disposed in at least some of the sets of notches, the members all being planar sheets.

* * * * *